United States Patent [19]

Kingswell

[11] 4,021,963

[45] May 10, 1977

[54] ACTION TOY

[75] Inventor: Henry Kingswell, Weston, Canada

[73] Assignee: The Raymond Lee Organization, Inc., New York, N.Y. ; a part interest

[22] Filed: July 1, 1976

[21] Appl. No.: 701,646

[52] U.S. Cl. ..... 46/220; 46/114

[51] Int. Cl.[2] ..... A63H 33/02

[58] Field of Search ..... 46/114, 112, 205, 220, 46/103, 111, 178, 201

[56] References Cited

UNITED STATES PATENTS

| | | | |
|---|---|---|---|
| 3,001,325 | 9/1961 | Riccobono et al. | 46/220 |
| 3,935,668 | 2/1976 | Phillips, Jr. | 46/220 |

*Primary Examiner*—Louis G. Mancene
*Assistant Examiner*—Mickey Yu
*Attorney, Agent, or Firm*—Daniel Jay Tick

[57] ABSTRACT

A wheel has a planar surface of disc-like configuration having a rim therearound of circular cross-section with a gap formed therein opposite the planar surface. The wheel is rollable along its rim for rotation about an axis through the center of the planar surface and perpendicular thereto. A rod for rolling the wheel has spaced opposite first and second ends with a handle at the first end and a circular part at the second end. The circular part has a gap formed therein and adapted to fit around the outside of the rim of the wheel. A braking member extends angularly from the second end of the rod to a point within and spaced from the circular part and passing through the gap of the rim and is adapted to abut the inside of the rim to halt the rolling of the wheel.

2 Claims, 3 Drawing Figures

ACTION TOY

BACKGROUND OF THE INVENTION

The present invention relates to an action toy.

Objects of the invention are to provide an action toy of simple structure, which is inexpensive in manufacture, and provides considerably enjoyment, recreational pleasure, interest, amusement and exercise for young and old alike.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 2:
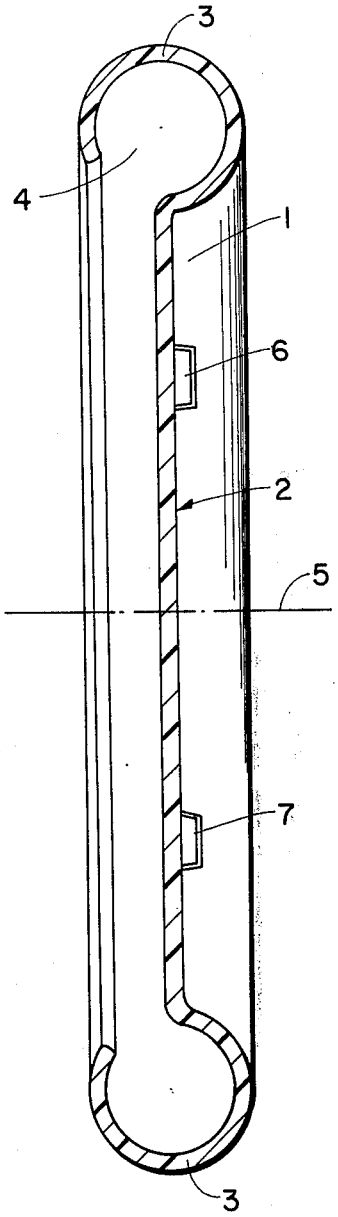
FIG. 2 is a diametrical cross-sectional view, on an enlarged scale, of an embodiment of the wheel of the action toy of the invention.
Figure 3:
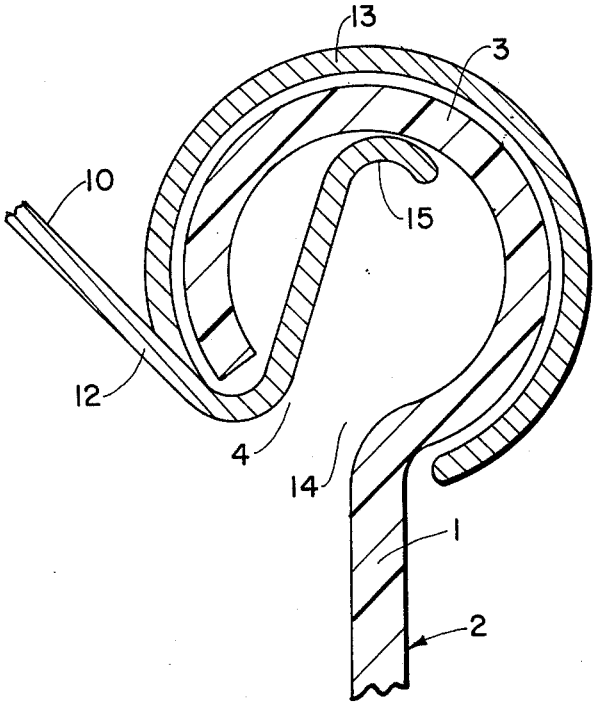
FIG. 3 is a cross-sectional view, on an enlarged scale, of part of an embodiment of the wheel and part of an embodiment of the rod of the action toy of the invention.

The action toy of the invention comprises a wheel 1 having a substantially planar surface 2 of disc-like configuration having a rim 3 therearound of substantially circular cross-section (FIGS. 2 and 3). The rim 3 has a gap 4 formed therein substantially opposite the planar surface 2 (FIGS. 2 and 3). The wheel 1 is rollable along its rim 3 for rotation about an axis 5 (FIG. 2) through the center of the planar surface 2 and substantially perpendicular thereto.

A plurality of whistles 6, 7, 8, 9 and so on (FIG. 1) are affixed to the planar surface 2 of the wheel and whistle as air passes through them during rolling of the wheel.

Figure 1:
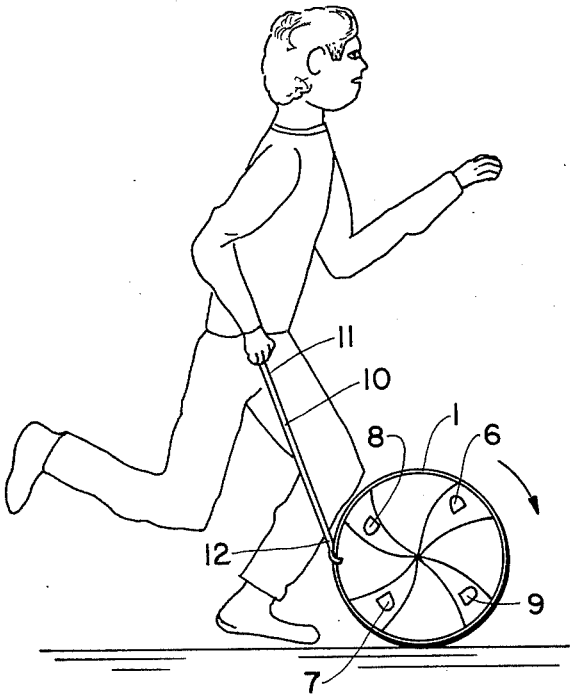
FIG. 1 is a side view of the embodiment of the action toy of the invention in use.

A rod 10 (FIGS. 1 and 2) is provided for rolling the wheel 1. The rod 10 has spaced opposite first and second ends 11 and 12, respectively (FIG. 1). A handle is provided at the first end 11 (FIG. 1) and a substantially circular part 13 is provided at the second end 12 of the rod 10 (FIG. 3). The circular part 13 has a gap 14 (FIG. 3) formed therein and is adapted to fit around the outside of the rim 3 of the wheel, as shown in FIG. 3. A braking member 15 extends angularly from the second end 12 of the rod 10 to a point within, and spaced from, the circular part 13, as shown in FIG. 3, and passes through the gap 4 of the rim 3 and is adapted to abut the inside of said rim to halt the rolling of the wheel.

While the invention hs been described by means of a specific example and in a specific embodiment, I do not wish to be limited thereto, for obvious modifications will occur to those skilled in the art without departing from the spirit and scope of the invention.

I claim:

1. An action toy, comprising a wheel having a substantially planar surface of disc-like configuration having a rim therearound of substantially circular cross-section with a gap formed therein substantially opposite said planar surface, said wheel being rollable along its rim for rotation about an axis through the center of said planar surface and substantially perpendicular thereto; and a rod for rolling the wheel, said rod having spaced opposite first and second ends, a handle at the first end and a substantially circular part at the second end, said substantially circular part having a gap formed therein and being adapted to fit around the outside of the rim of the wheel, and a braking member extending angularly from the second end of the rod to a point within and spaced from the circular part and passing through the gap of the rim and being adapted to abut the inside of the rim to halt the rolling of the wheel.

2. An action toy as claimed in claim 1, further comprising a plurality of whistles affixed to the planar surface of the wheel for whistling as air passes through them during rolling of the wheel.

* * * * *